US005831500A

United States Patent [19]

Turner et al.

[11] Patent Number: 5,831,500

[45] Date of Patent: Nov. 3, 1998

[54] TRIP FLAG GUIDE FOR A CIRCUIT BREAKER

[75] Inventors: Duane Lee Turner, Cedar Rapids; James Arthur Heise, Cedar Falls, both of Iowa

[73] Assignee: Square D Company, Palatine, Ill.

[21] Appl. No.: 701,896

[22] Filed: Aug. 23, 1996

[51] Int. Cl.[6] ..... H01H 73/12

[52] U.S. Cl. ..... 335/17; 335/14; 335/16; 335/20; 335/35; 200/400

[58] Field of Search ..... 335/17, 14, 16, 335/20, 35; 200/400

[56] References Cited

U.S. PATENT DOCUMENTS

| | | | |
|---|---|---|---|
| 3,742,403 | 6/1973 | Nicol | 335/13 |
| 4,623,859 | 11/1986 | Erickson et al. | 335/14 |
| 5,075,659 | 12/1991 | Morgan et al. | 335/17 |
| 5,180,051 | 1/1993 | Cook et al. | 200/400 |

*Primary Examiner*—Michael L. Gellner
*Assistant Examiner*—Tuyen T. Nguyen
*Attorney, Agent, or Firm*—Kareem M. Irfan; Larry I. Golden

[57] ABSTRACT

A circuit breaker device for interrupting current in a circuit path between a source and a load. The device includes a first contact and a second contact cooperatively arranged in the circuit path so as to provide current from the source to the load. At least one of the contacts is disposed on a contact carrier which is movable for interrupting the current provided to the load. A contact status indication arrangement is provided for indicating the status of the contacts. The contact status indication arrangement includes a trip flag, a status insert, a clear plastic lens, a flag guide, and a status flag. The trip flag, status insert and status flag are viewable through the lens, which is disposed in an aperture in the circuit breaker housing. Only one status indicator is viewable through the lens at any one time, each indicating a different circuit breaker status. For example, when the trip flag is visible, the circuit breaker is in the TRIPPED position; when the status insert is visible, the circuit breaker is in the OPEN position; and when the status flag is visible, the circuit breaker is in the CLOSED position. One end of the trip flag is coupled to a trip lever and the other end rides on the flag guide as the trip flag moves forward and back when the circuit breaker moves into the TRIPPED position and is then reset, respectively. The flag guide is a staple-shaped piece of wire disposed in the housing and provides a reliable guide on which the trip flag to travel and maintains separation between the trip flag and the statues flag.

15 Claims, 12 Drawing Sheets

TRIP FLAG GUIDE FOR A CIRCUIT BREAKER

RELATED APPLICATIONS

The subject matter of this application is related to a circuit breaker as disclosed in U.S. patent application Ser. No. 08/701,844 entitled "Manual Override Mechanism for a Remote Controlled Circuit Breaker", U.S. patent application Ser. No. 08/703,330 entitled "Coupling Member for Securing a Spring to a Rotatable Motor Shaft" and U.S. patent application Ser. No. 08/697,383 entitled "Improved Calibration Means for a Circuit Breaker" filed on even date herewith. The above applications have the same assignee as the present invention and are incorporated herein by reference in their entirety.

FIELD OF THE INVENTION

The present invention relates generally to circuit breakers and, more particularly, to improvements in the status indication of circuit breakers.

BACKGROUND OF THE INVENTION

Remote control circuit breakers are commonly used for temporary interruption of electrical service during peak use hours and for programmable lighting control of industrial locations. By opening and closing on demand from a remote location, these circuit breakers provide a significant improvement over manually operated circuit breakers in terms of convenience.

Remotely controlled circuit breakers are disclosed in U.S. Pat. No. 5,180,051 entitled "Remote Controlled Circuit Breaker" and U.S. Pat. No. 5,532,660 entitled "Manual Override Mechanism for a Remote Controlled Circuit Breaker" which are assigned to the same assignee as the present application and the disclosures therein are incorporated herein by reference. The remote controlled circuit breaker disclosed in these patents includes a first contact and a second contact cooperatively arranged in a circuit path so as to provide current from a source to a load. At least one of the contacts is disposed on a contact carrier which is movable for interrupting the current provided to the load. A gear mechanism is provided to allow for remotely controlling the interruption of the current path. The gear mechanism includes a motor with a rotatable shaft which responds to open and closed control signals generated from a remote location, and a gear, rotatably responsive to the rotatable shaft, for controlling the contact carrier so that the circuit path is interrupted and established, respectively. The gear mechanism controls the contact carrier using a coupling arrangement, which has a hook-shaped coupling member coupled to the contact carrier and a second part coupled to the gear. A contact status indication arrangement is provided for indicating the status of the contacts. The contact status indication arrangement includes a trip flag, disposed in a slot in the base of the circuit breaker, and a status indicator disposed on the hook-shaped coupling member. When the trip flag is visible through a window in the cover of the circuit breaker, the circuit breaker is in a tripped position. When the status flag is visible through the window, the circuit breaker is in the closed position.

While the above-described contact status indication as described in U.S. Pat. Nos. 5,180,051 and 5,532,660 is adequate for indicating the status of the contacts in the circuit breaker, it is difficult to manufacture. The slot is molded into the base of the circuit breaker and is difficult to see thereby making it difficult to assure that the trip flag is installed in the proper location during assembly. If the trip flag is not installed properly it could be damaged when the circuit breaker cover is installed onto the base. Additionally, the trip flag and the status flag would occasionally collide, especially if the trip flag was damaged during assembly.

Therefore, there exists a distinct need for an improved means for an improved contact status indication arrangement.

SUMMARY OF THE INVENTION

It is a general object of the present invention to provide an improved circuit breaker arrangement which is convenient to monitor the status of the circuit breaker.

It is a more specific object of the present invention to provide a circuit breaker having an improved contact status indication arrangement.

In accordance with the present invention, the deficiencies of the prior art are overcome by providing a circuit breaker device for interrupting current in a circuit path between a source and a load. The device includes a first contact and a second contact cooperatively arranged in the circuit path so as to provide current from the source to the load. At least one of the contacts is disposed on a contact carrier which is movable for interrupting the current provided to the load.

A contact status indication arrangement is provided for indicating the status of the contacts. The contact status indication arrangement includes a trip flag, a status insert, a clear plastic lens, a flag guide, and a status flag. The trip flag, status insert and status flag are viewable through the lens, which is disposed in an aperture in the circuit breaker housing. Only one status indicator is viewable through the lens at any one time, each indicating a different circuit breaker status. For example, when the trip flag is visible, the circuit breaker is in the TRIPPED position; when the status insert is visible, the circuit breaker is in the OFF or OPEN position; and when the status flag is visible, the circuit breaker is in the ON or CLOSED position.

One end of the trip flag is coupled to a trip lever and the other end rides on the flag guide as the trip flag moves forward and back when the circuit breaker moves into the TRIPPED position and is then reset, respectively. The flag guide is a staple-shaped piece of wire disposed in the housing and provides a reliable guide on which the trip flag to travel. Furthermore, the flag guide assures that the trip flag is installed in the proper location during assembly of the circuit breaker. Additionally, the wire guide maintains separation between the trip flag and the status flag.

BRIEF DESCRIPTION OF THE DRAWINGS

Other objects and advantages of the invention will be apparent from the following detailed description and the accompanying drawings in which.

Figure 1:
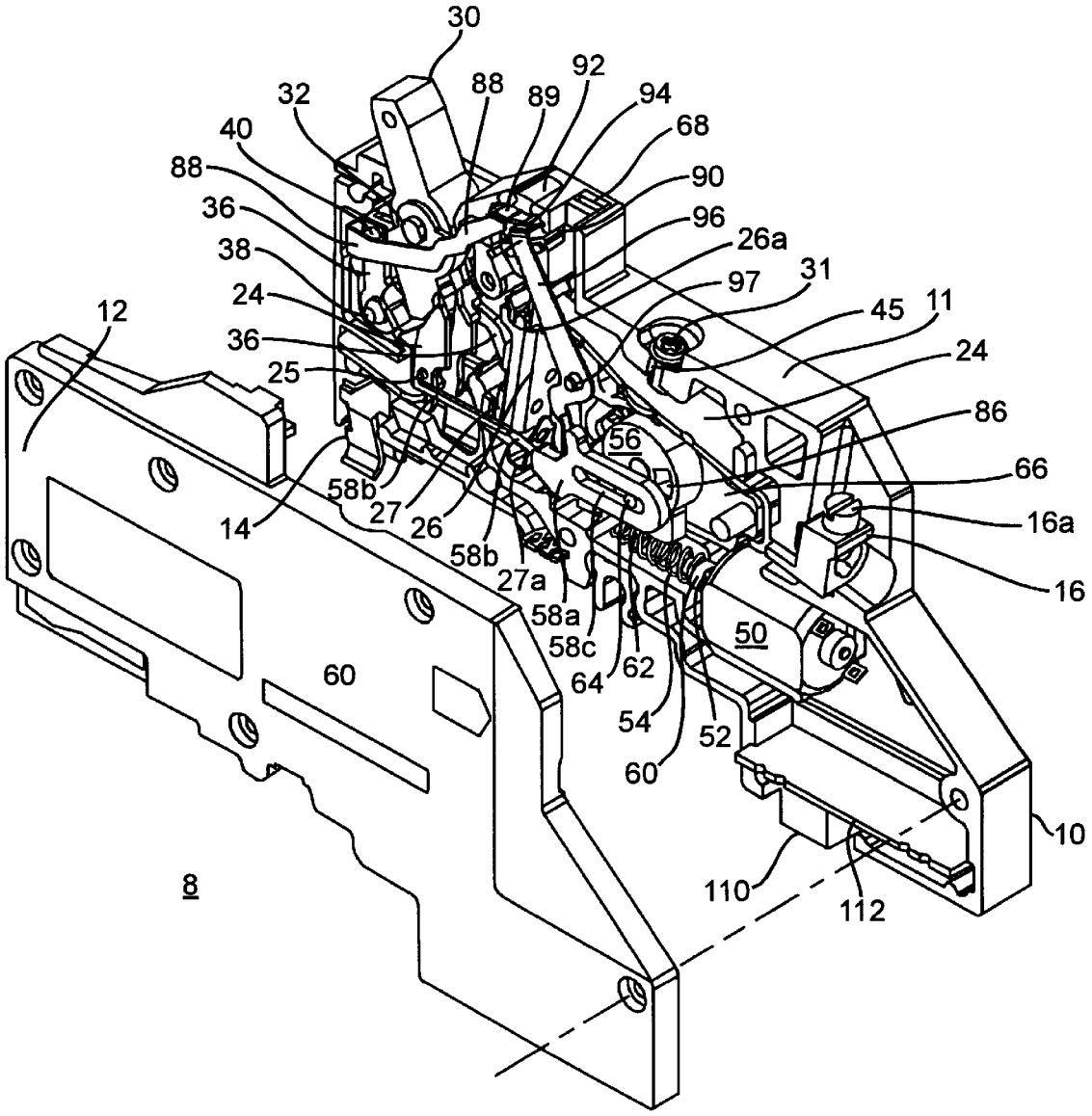
FIG. 1 is a perspective view of a remote controlled circuit breaker device according to the present invention, illustrating a housing and a cover.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the invention is to cover all modifications, equivalents, and alternatives falling within the spirit and scope of the invention as defined by the appended claims.

DETAILED DESCRIPTION OF THE PREFERRED EMBODIMENT

Turning now to the drawings and referring specifically to FIGS. 1–5, there is illustrated a remotely controllable circuit breaker device 8 according to the present invention. The circuit breaker device 8 includes an electrically insulative body or housing 10 closed at one face by a detachable cover 12, a line terminal 14 and a load terminal 16 for completing the circuit between the source and load (not shown). More specifically in FIG. 2, the circuit path beginning at the line terminal 14 carries current through stationary and movable contacts 18 and 20 and through a flexible copper conductor 22, which is attached between a contact carrier 24 and a bimetal member 28. A conductive calibration plate 29, which is attached to the bimetal member 28, carries current from the bimetal member 28 to the load terminal 16 via a second flexible copper conductor 23, which is attached between the conductive calibration plate 29 and the load terminal 16.

The above-described current path is controlled remotely and locally by a number of different components, some of which are similar in structure and operation to the corresponding components described in U.S. Pat. No. 4,623,859, entitled "Remote Control Circuit Breaker" and U.S. Pat. No. 5,245,302 entitled "Automatic Miniature Circuit Breaker With Z-Axis Assemblable Trip Mechanism" which are assigned to the same assignee as the present application and the disclosures therein are incorporated herein by reference in their entirety. For example, local control of the circuit breaker device 8 is provided using an external operating handle 30 pivotally mounted about an axis 32 in the housing 10 to control the contact carrier 24. The upper end of the contact carrier 24 is rotatably secured to the bottom of the operating handle 30 so that the contact carrier 24 can be rocked clockwise and counterclockwise using a toggle spring 34. The toggle spring 34 is secured to the bottom of the contact carrier 24 and to an equilibrium position on a trip lever 36 so as to urge the contact carrier 24 toward the handle 30. The trip lever 36 is rotatable about a pin 38 at one end and has a latching surface 36*a* at its other end.

In response to movement of the handle 30 to the right (OPEN position) or left (CLOSED position), the contact carrier 24 is moved counterclockwise or clockwise, respectively, by the action of the toggle spring 34. The handle 30 moves the top of the contact carrier 24 to either side of the equilibrium position, so that the bottom of the contact carrier 24 biases the movable contact 20 to either the OPEN or CLOSED position.

The trip mechanism assembly includes an armature 27, an armature compensator 27*a* welded to the armature 27, the bimetal member 28 and a yoke 26. The armature 27 is pivotally supported in an armature pivot 26*a* in the yoke 26. The armature 27 includes an aperture in which a latch point 27*b* is provided to engage the latching surface 36*a* for holding or latching the trip lever 36 thereon. Upon the occurrence of a moderately sustained overload, from the CLOSED position (FIG. 2), the bimetal member 28 heats up and flexes to the right, causing the armature 27 and the yoke 26 to swing counterclockwise so as to release the stand-off pressure of the end of the trip lever 36 from the latch point 27*b*. This causes the trip lever 36 to rotate clockwise (FIG. 4) and the toggle spring 34 to pull the contact carrier 24, and the movable contact 20, away from the stationary contact 18 so as to interrupt the current path.

Figure 4:
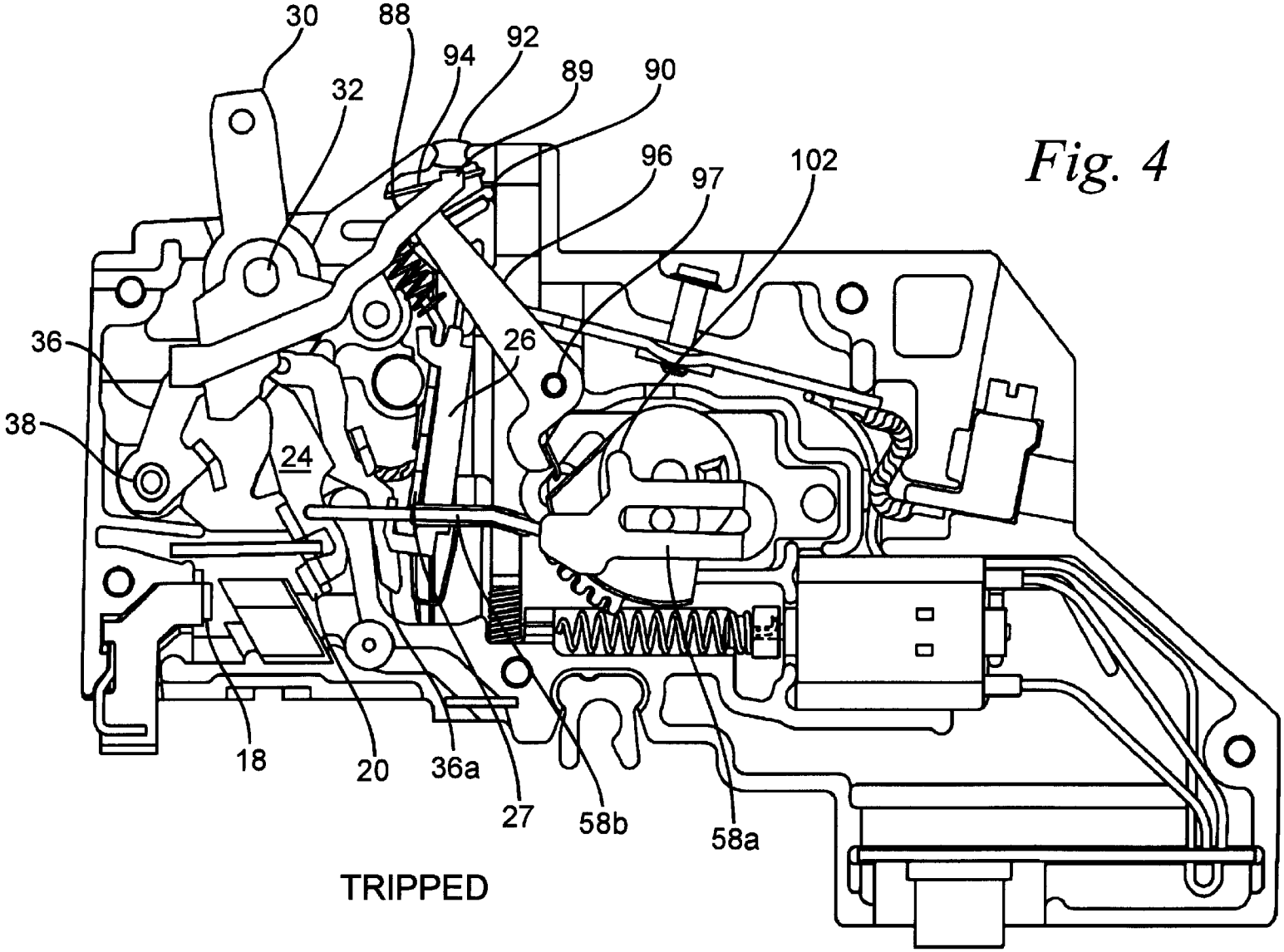
FIG. 4 is a side view of the circuit breaker of FIG. 1 with the cover removed, showing the circuit breaker in the TRIPPED position.

Similarly, upon the occurrence of an extensive current overload, the yoke 26 manifests a magnetic force that attracts the armature 27, causing it to travel counterclockwise, as shown in FIG. 4, so as to release the stand-off pressure on the latching surface 36*a* from the latch point 27*b*. This causes the trip lever 36 to rotate clockwise and the toggle spring 34 to pull the contact carrier 24 to separate the contacts 18 and 20 so that the current path is interrupted.

After being tripped as described above, the trip mechanism assembly is reset by cocking the operating handle 30 to the right so that the bottom of the operating handle 30 pushes a reset pin 40. This engagement of the reset pin 40 rotates the trip lever 36 in a counterclockwise direction to allow the latching surface 36*a* to engage the latch point 27*b*.

Figure 6:
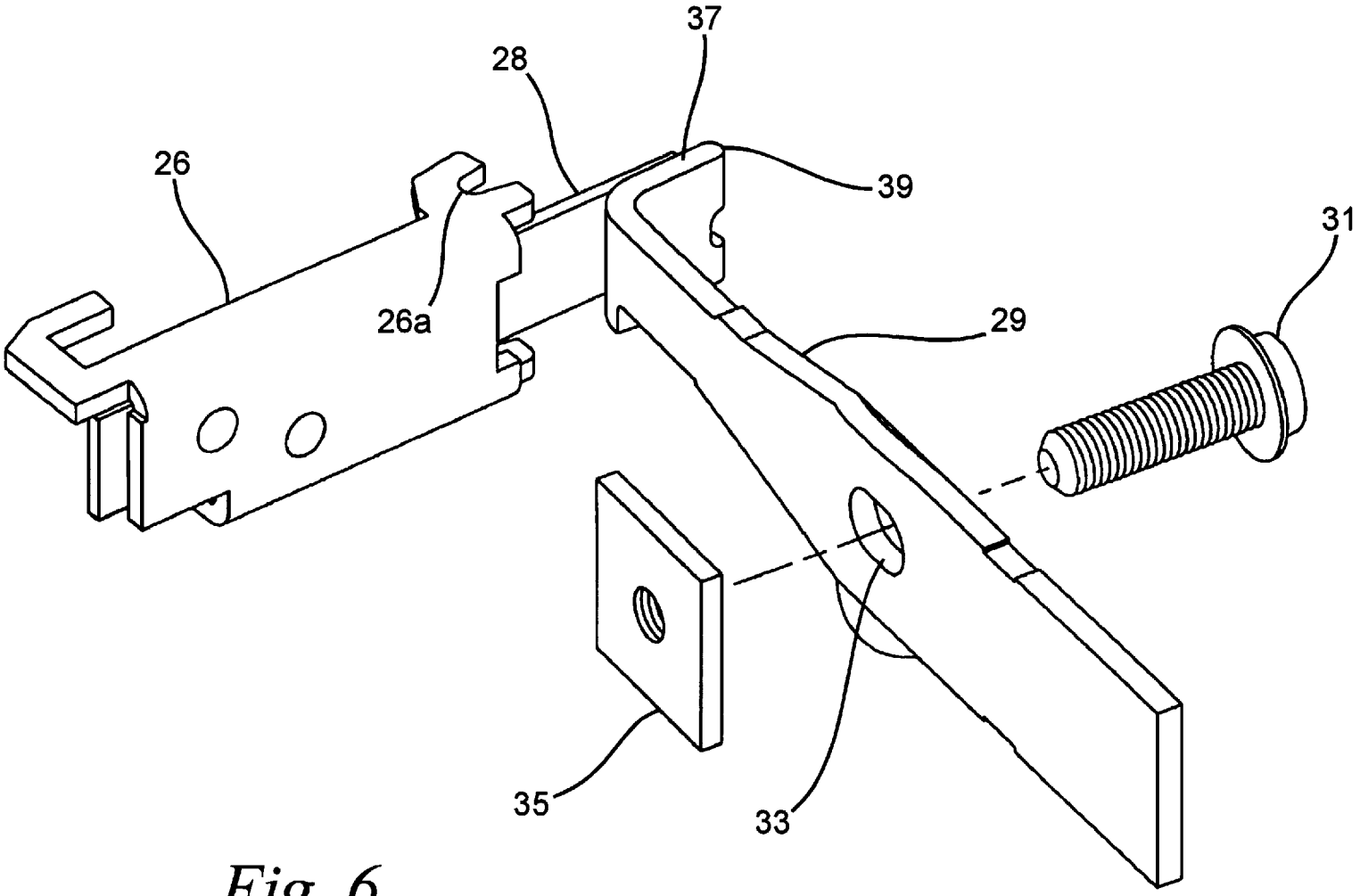
FIG. 6 is a perspective view of the preferred embodiment of a calibration assembly for use in the circuit breaker of FIG. 1.
Figure 14:
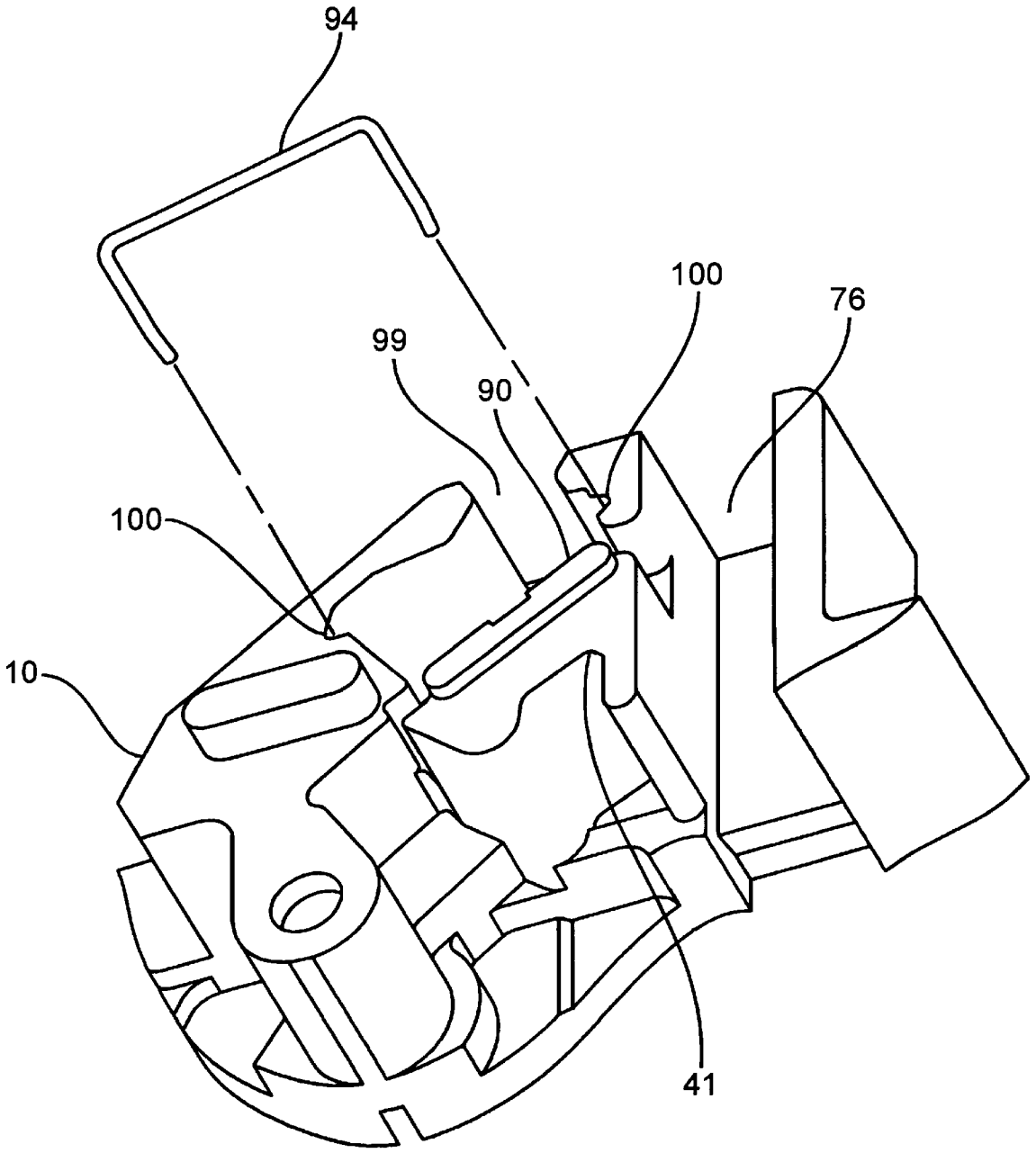
FIG. 14 is a partial exploded view of the housing for the circuit breaker of FIG. 1, according to a preferred embodiment of the present invention.

The amount of current that is required to cause the circuit breaker to trip is determined by the amount of overlap between the latching surface 36*a* and the latch point 27*b*. As shown in FIGS. 2 and 6, the preferred embodiment utilizes an improved calibration assembly to provide for increased calibration reliability in changing this overlap. The calibration assembly includes the calibration plate 29, the second flexible conductor 23, and a calibration screw 31. The calibration screw 31 extends through an aperture 45 (FIG. 1) in a wall 11 of the housing 10 and a slotted aperture 33 in the calibration plate 29. A substantially square shaped nut 35 secures the calibration screw 31 tightly against the wall 11. The calibration plate 29 includes a leg portion 37 bent substantially perpendicular thereto which has a rounded end 39 supported in a v-block 41 (FIG. 14) formed in the housing 10. The rounded end 39 of the calibration plate provides a pivot for which the calibration plate 29 rotates thereabout. The calibration plate 29 is prevented from sliding horizontally and vertically by the v-block 41. The other end of the calibration plate 29 is supported and prevented from vertical movement by a support block 43 formed in the housing 10; however, the calibration plate 29 is allowed to slide horizontally along the support block 43. The support block 43 and the v-block 41 support the calibration plate 29 at both ends thereof; however, the middle portion of the calibration plate 29 is not supported thereby allowing it to bend into a gap between the calibration plate 29 and the housing wall 11. The slotted aperture 33 allows the calibration plate 29 to slide horizontally and bend as the calibration screw 31 is tightened into the square nut 35. The square nut 35 provides strength to the calibration plate 29 in the area of the slotted aperture 33. A lubricant is applied to the side of the square nut 35 adjacent to the calibration plate 29 to reduce the friction between the calibration plate 29 and the square nut 35. The lubricant utilized in the preferred embodiment is available as part no. 63860 from Bel-Ray Corporation of Farmingdale, N.J.

The circuit breaker device 8 is calibrated at the time it is assembled so that the amount of current that is required to cause it to interrupt the current path is pre-determined. To calibrate the circuit breaker device 8, the calibration screw 31 is tightened in order to press the calibration plate 29 against the v-block 41 and the support block 43. As the calibration screw 31 is tightened, the calibration plate 29 bends, thereby rotating the bimetal member 28 and the yoke 26 about the rounded end 39 of the calibration plate in a counterclockwise direction. As the yoke 26 rotates counterclockwise it engages the armature compensator 27*a* and forces the armature 27 to rotate counterclockwise. As the armature 27 rotates counterclockwise, the latch point 27*b* rotates away from the trip lever 36 causing a reduction in the amount of overlap between the latching surface 36*a* and the latch point 27*b*. This reduction in the overlap reduces the amount of travel required of the armature 27 before the stand-off pressure is released, thereby requiring less current to cause the trip mechanism to trip. An advantage of the second flexible conductor 23 is that a screw 16*a* in the load terminal 16 may be tightened to secure a wire therein without effecting the amount of bend in the calibration plate 29 which causes the circuit breaker device 8 to become un-calibrated. Additionally, the v-block 41 supports the rounded end 39 of the calibration plate therein thereby preventing the leg portion 37 from moving out of position and causing the amount of overlap between the latching surface 36*a* and the latch point 27*b* from changing.

Figure 7:
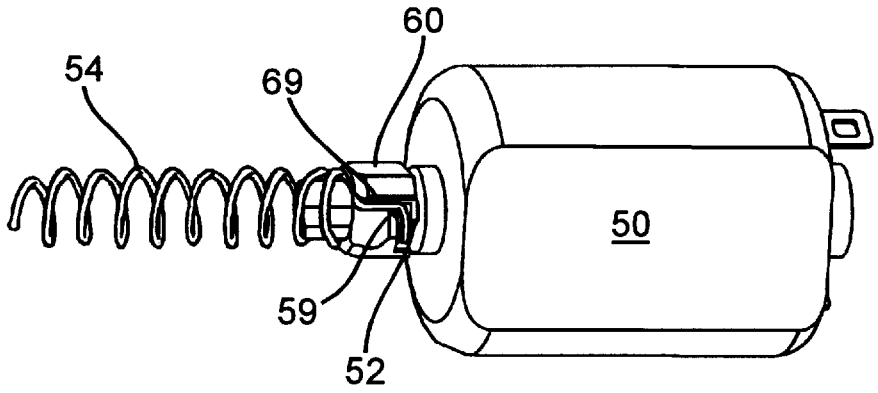
FIG. 7 is a perspective view of a motor assembly for use in the circuit breaker of FIG. 1, according to a preferred embodiment of the present invention.
Figure 8:
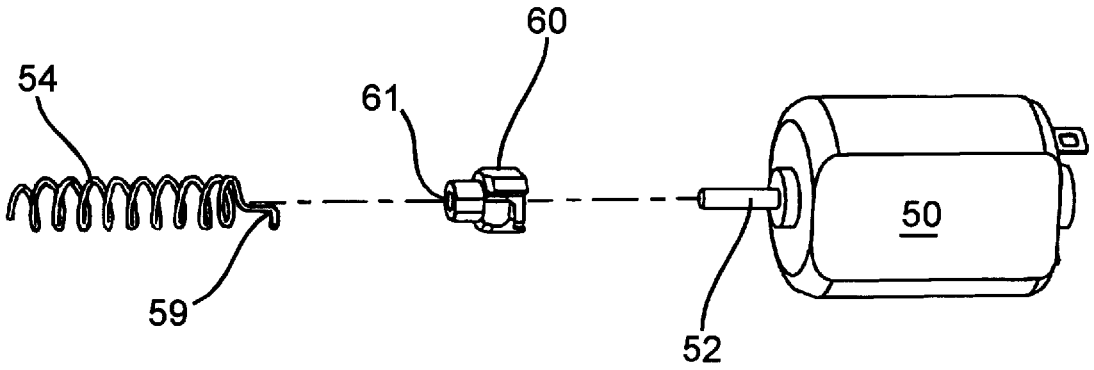
FIG. 8 is an exploded view of the motor assembly of FIG. 7, according to a preferred embodiment of the present invention.
Figure 10:
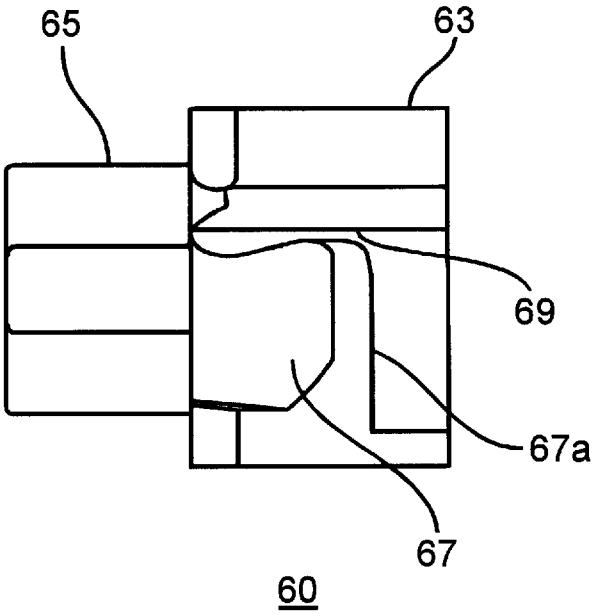
FIG. 10 is a top view of the coupler used to couple the spring to the motor shaft for the motor assembly shown in FIG. 7, according to a preferred embodiment of the present invention.
Figure 9:
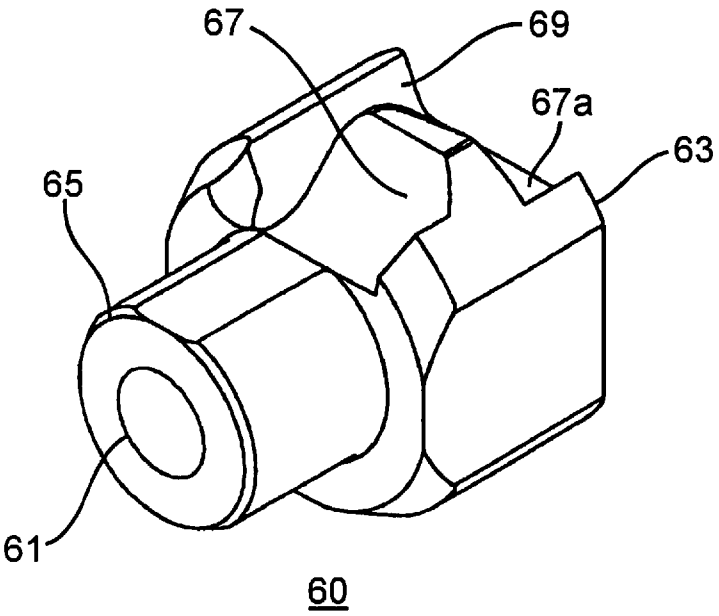
FIG. 9 is an isometric view of the preferred embodiment of a coupler used to couple a spring to a motor shaft for the motor assembly shown in FIG. 7.
Figure 12:
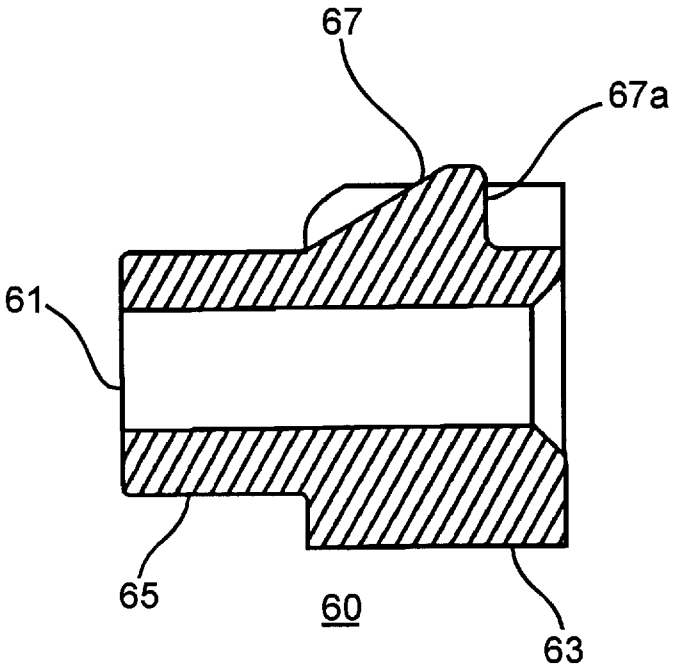
FIG. 12 is a cross-sectional view of the coupler of FIG. 11 taken along the line 12—12 of FIG. 11, according to a preferred embodiment of the present invention.
Figure 11:
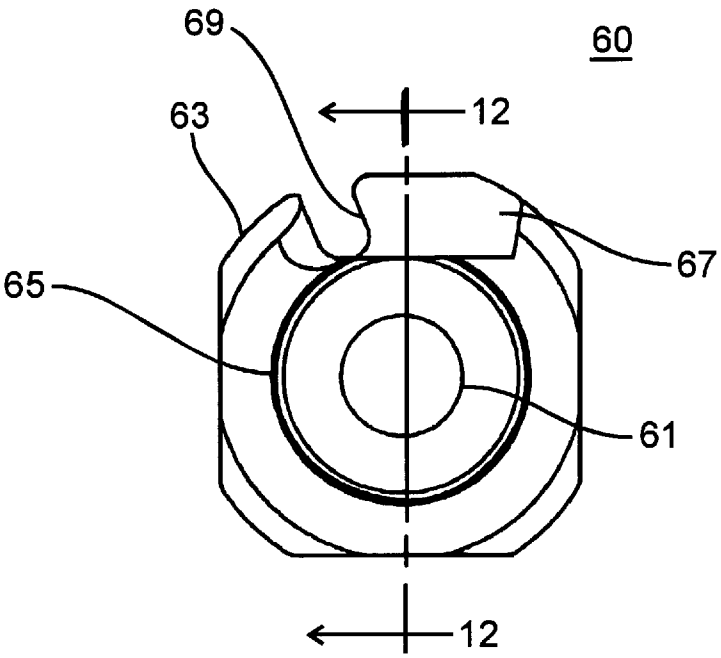
FIG. 11 is a front view of the coupler used to couple the spring to the motor shaft for the motor assembly shown in FIG. 7, according to a preferred embodiment of the present invention.

As shown in FIG. 2, remote control of the circuit breaker device 8 is provided using a motor 50 having a shaft 52 which rotates in one direction to pull the contact carrier 24 and break, or OPEN, the current path and which rotates in the opposite direction to allow the contact carrier 24 to be pulled by the toggle spring 34 to re-establish, or CLOSE, the current path. This is accomplished with a shaft spring 54 which is coupled to the shaft 52, and a gear 56 which rotates about a pin 57 to control a drive rod assembly or coupling arrangement 58. The coupling arrangement 58 includes: (i) a plate member 58*a* having a slotted aperture 58*c* defined therein for accommodating a coupling pin 64 linked to the gear 56; and (ii) a hook-shaped coupling member 58*b* having a leg portion which extends into a hole 25 in the contact carrier 24 for pulling the contact carrier 24. The shaft spring 54 is coupled to the shaft 52 via a unique coupler 60. As illustrated more clearly in FIGS. 7 and 8, the coupler 60 is pressed onto the motor shaft 52 and fits snugly thereon so that the coupler 60 rotates with the motor shaft 52 thereby causing the shaft spring 54 to rotate with the motor shaft 52. Referring back to FIG. 2, the gear 56 includes teeth 62 which interlock with the windings of the spring 54 to establish a linear relationship between the rotation of the shaft 52 and the rotation of the gear 56 about the pin 57. For example, clockwise rotation of the shaft 52 may correspond to a counterclockwise rotation of the gear 56 about the pin 57. The dimensions of the coupling arrangement 58, and more particularly, of the plate member 58*a*, aperture 58*c* and the leg portion of the hook-shaped member 58*b* are predetermined so as to provide a gap in the aperture 58*c* on the right side of the coupling pin 64 when the gear 56 is fully rotated clockwise.

The coupling pin 64, which is secured to and protrudes out of the gear 56, responds to the rotation of the gear 56 to control the position of the contact carrier 24 by virtue of being coupled thereto through the coupling arrangement 58. As the gear teeth 62 move with the shaft spring 54, the side of the gear 56 opposite the teeth 62 rotates to the same degree, thereby forcing the coupling pin 64 to rotate about the pin 57.

Figure 3:
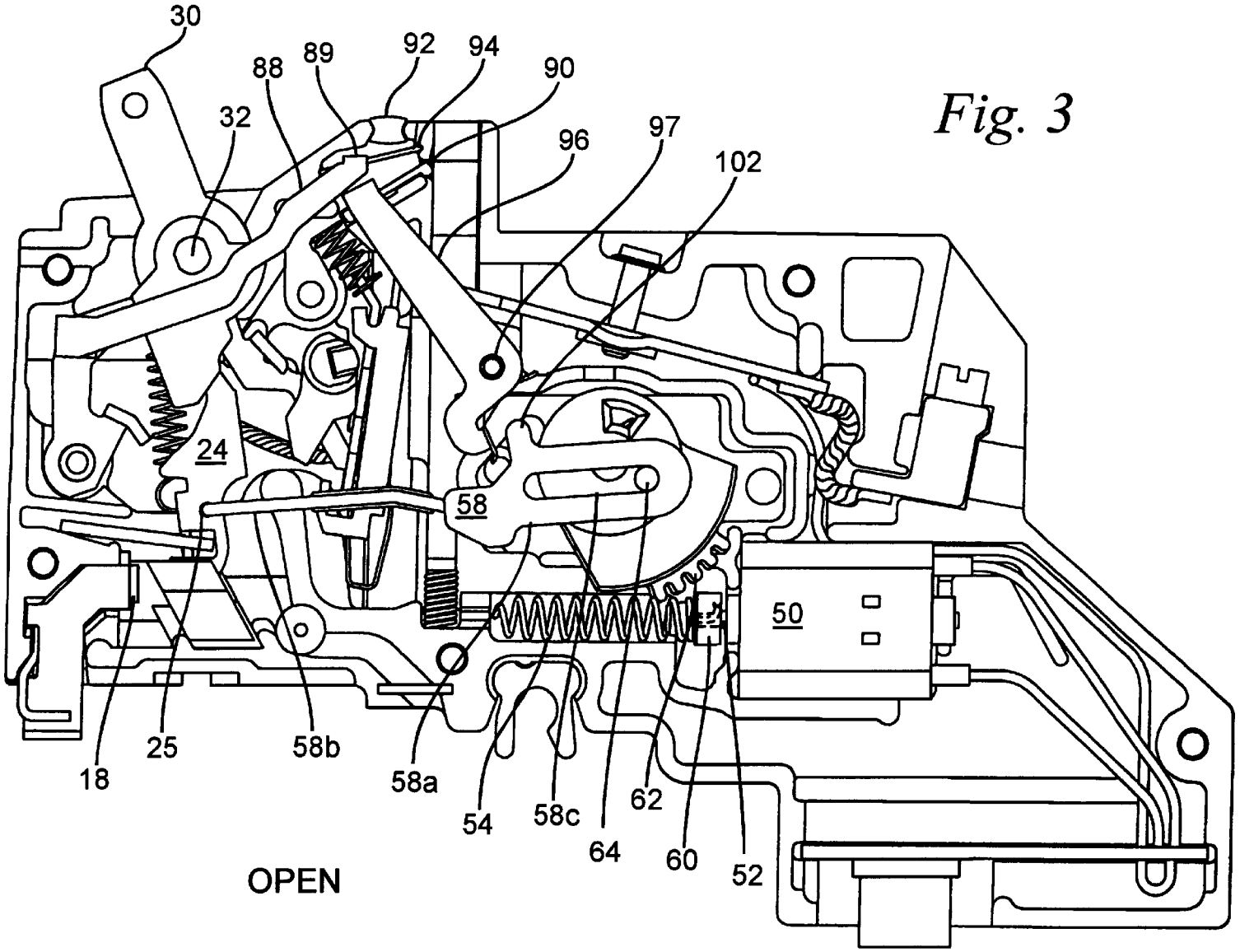
FIG. 3 is a side view of the circuit breaker of FIG. 1 with the cover removed, showing the circuit breaker in the OPEN position.

As shown in FIG. 3, the shaft spring 54 rotates in the clockwise rotation in response to the motor 50 rotating its shaft 52 in a clockwise rotation causing the gear 56 to rotate in the counterclockwise direction. As the gear 56 rotates in the counterclockwise direction, the coupling pin 64 moves towards the motor 50 and engages the end of the aperture 58*c* and continues to move towards the motor 50 thereby pulling the plate member 58*a*. As a result of pulling the plate member 58*a*, the contact carrier 24 pulls away from the stationary contact 18.

Referring once again to FIG. 2, in response to the motor 50 operating in the opposite direction (counterclockwise), the shaft 52 rotates the shaft spring 54 in the counterclockwise direction which rotates the gear 56 in the clockwise direction. As the gear rotates in the clockwise direction, the coupling pin 64 moves away from the motor 50 and separates from the end of the aperture 58*c* which then allows the toggle spring 34 to return the contact carrier 24 to the CLOSED position if the handle 30 is in the ON or CLOSED position.

As shown in FIGS. 9–12, the coupler 60 is preferably made of reinforced nylon and has a cylindrical hollow middle 61 which fits snugly onto the motor shaft 52. It is also suitable to make the coupler 60 out of any thermoplastic type of material which has good wear resistance. The coupler 60 includes a main body portion 63 and a smaller cylindrically shaped nose portion 65 extending from the body portion 63 for receiving coils of the shaft spring 54 (FIG. 2) thereabout. The main body portion 63 includes a ramp portion 67 extending upwardly therefrom and a slot 69 therein for receiving a hook portion 59 (FIG. 8) extending from the shaft spring 54. During manufacture of the circuit breaker, the hook portion 59 is pushed up the ramp 67 until it snaps over the ramp portion 67 and behind a wall 67*a*. The hook portion 59 is snugly secured behind the wall 67*a* and in the slot 69 so that as the motor shaft 52 (FIG. 2) rotates, the coupler 60 causes the spring 54 (FIG. 2) to rotate.

Figure 13:
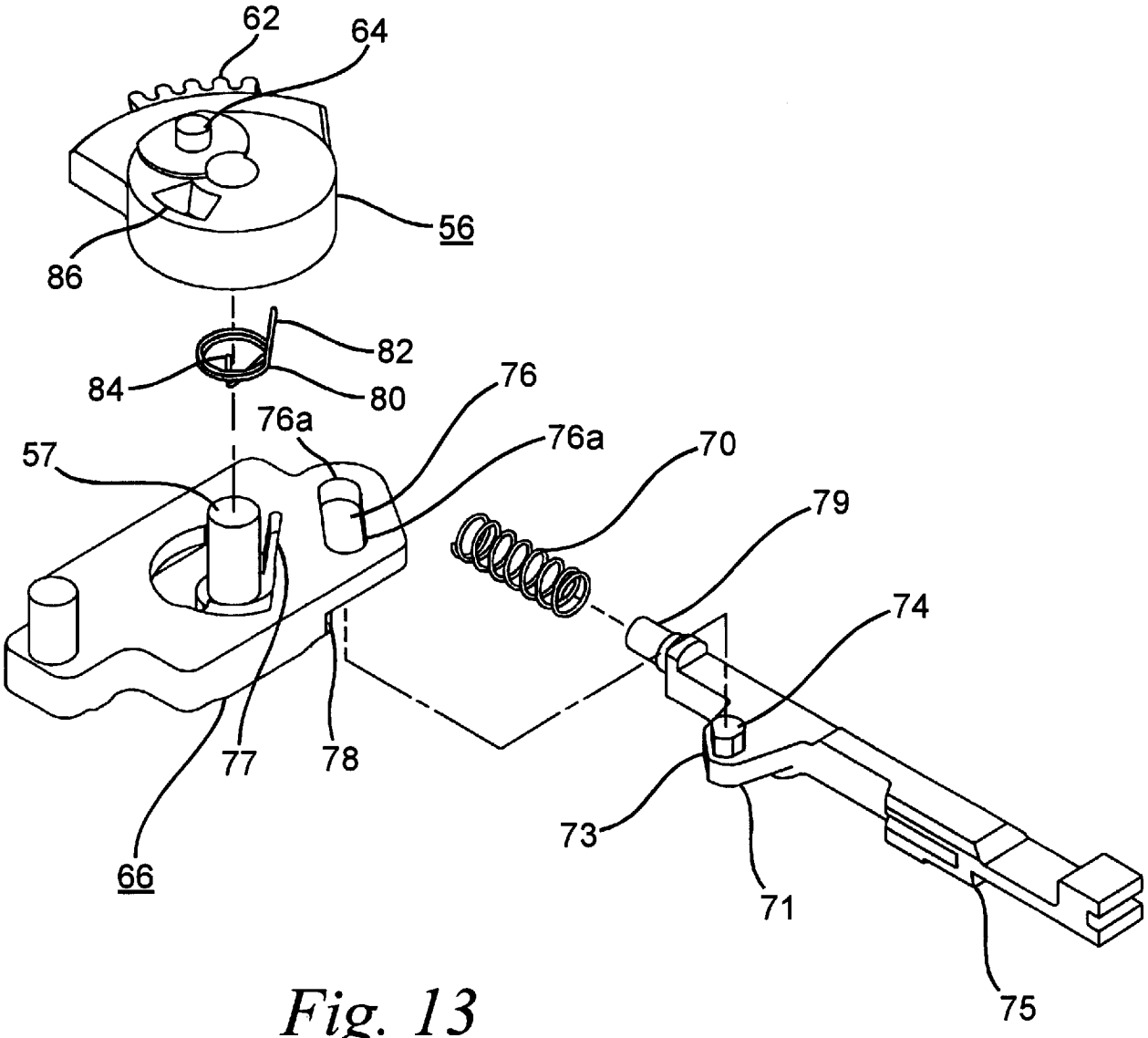
FIG. 13 is an exploded view of the override mechanism used to disable the remote control mechanism for the circuit breaker of FIG. 1, according to a preferred embodiment of the present invention.

As shown in FIGS. 2 and 13, the remote control circuit breaker device 8 described above is provided with a manual override mechanism for overriding or disabling the remote control mechanism of the circuit breaker. The override mechanism includes a slide mechanism 66, an override button 68 and a bias spring 70. The remote control mechanism is disabled when the override button 68 is released from a latched position so as to release a releasable holding force from the slide mechanism 66. More specifically, the pin 57, about which the gear 56 rotates, is defined as an integral part of the slide mechanism 66 and may be used to override or disable the remote control mechanics of the circuit breaker device 8. The releasable holding force is implemented by biasing the spring 70 between the override button 68 and a bottom portion of the housing 10.

FIG. 13 shows the override button 68 preferably has an elongated body integrally formed with a tab portion 71 extending from one side thereof and a rounded extension 79 extending from one end thereof. The tab portion 71 has a relatively flat angled edge 73 and an interlock pin 74 projecting therefrom. The override button 68 has a ridge portion 75 projecting outwardly from another side thereof. The slide mechanism 66 includes the pin 57, a first slot 76, a second slot 77, and an angled edge 78 adapted for engagement with the edge 73 of the override button 68. The first slot 76 accepts the interlock pin 74 therein for interlocking the slide mechanism 66 to the override button 68. Because the pin 57 is integral to the slide mechanism 66 and the gear 56 is disposed around the pin 57, the gear 56 moves integrally with the slide mechanism 66.

With the above arrangement, the releasable holding force exerted by the spring 70 urges the ridge portion 75 on the override button 68 against a corresponding obstruction, such as a notch (not shown) on the surface of the housing 10. The spring 70 is supported on one end by the elongated extension 79 and on the other end by an inside surface of the housing 10.

Figure 5:
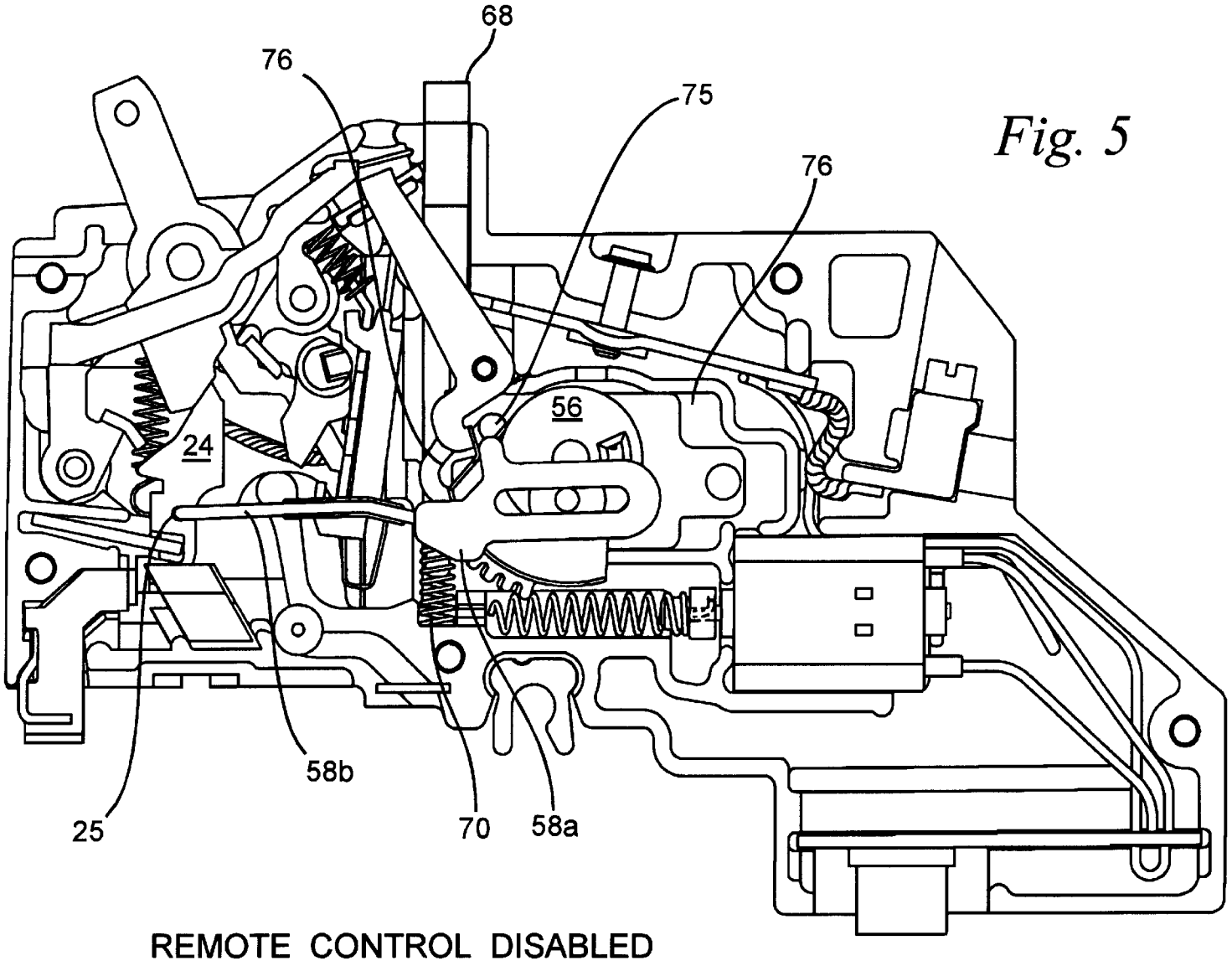
FIG. 5 is a side view of the circuit breaker with the cover removed, showing the circuit breaker with its remote control mechanism in the disabled position.

In normal remote control operation, the ridge 75 engages the notch on the housing 10, thereby holding the angled edge 73 of the override button 68 against the angled edge 78 on the slide mechanism 66. This engagement of the angled edges 73 and 78 causes the slide mechanism 66, and thusly the associated gear 56, to be in a position which allows the coupling pin 64 associated with the gear 56 to pull the contact carrier 24. Referring now to FIG. 5, the remote control operation is disabled by releasing the releasable holding force by depressing and laterally pushing the override button 68 so that the ridge 75 of the override button is removed from engagement with the notch on the housing 10. After the ridge 75 is removed from the notch, the override button 68 is released and the force of the spring 70 then pushes the override button 68 upwardly toward an aperture 76 (FIG. 14) in the housing 10 thereby moving the interlock pin 74 upwardly. This, in turn, forces the interlock pin 74 to slide in the first slot 76 from one of its ends 76*a* until it reaches an inner wall 76*b*. After the interlock pin 74 reaches the inner wall 76*b*, the bias of the spring 70 continues to pressure the interlock pin 74 upwardly and pulling the slide mechanism 66, and causing the associated gear 56, in a direction away from the motor 50. As a result, the gear 56 is no longer in a position from which the coupling pin 64 can pull the contact carrier 24. For example, the coupling pin 64 is pulled forward away from the motor 50 in the aperture 58*c*. Consequently, the pin 64 never engages the end of the aperture 58*c* and does not pull the contact carrier 24 in response to the rotation of the shaft spring 54, thereby disabling the remote control mechanism of the circuit breaker. An advantage of the preferred embodiment is that the spring 70 assists the toggle spring 34 to move the contact carrier 24 into the CLOSED position after the remote control operation is disabled if the handle 30 is in the CLOSED position. The spring 70 assists the toggle spring 34 by forcibly moving the slide mechanism 66 and the gear 56 away from the motor 50 thereby allowing the toggle spring 34 to move the contact carrier 24 into the CLOSED position.

The slide mechanism 66 is also designed to prevent disengagement of the teeth 62 from the shaft spring 54 when the remote control mechanics of the circuit breaker are not disabled and are being controlled by the motor 50. Because the shaft spring 54 can drive the gear 56 to either end of its teeth, it is conceivable that the motor 50 can overdrive the gear 56 to the extent that the shaft spring 54 is unable to maintain contact with the teeth 62. As illustrated in FIG. 13, to prevent potential disengagement, a torsion spring 80 having a first leg 82 and a second leg 84 is disposed between the slide mechanism 66 and the gear 56. The first leg 82 is disposed in the second slot 77 of the slide mechanism 66 and the second leg 84 is disposed in an aperture 86 in the gear 56. The torsion spring 80 biases the gear 56 so that at least one of the gear teeth maintains contact with the shaft spring 54 at all times. The torsion spring 86 thereby prevents gear overdrive when the gear 56 rotates in the either direction. For example, the torsion spring 86 biases the gear 56 clockwise when the gear is overdriven during counterclockwise rotation, so that the teeth 62 retain engagement with the shaft spring 54. If the gear 56 is overdriven after its counterclockwise rotation, the toggle spring 34 biases the gear 56 clockwise, by pulling the coupling pin 64 via the contact carrier 24 and the coupling member 58, so that the teeth 62 retain engagement with the shaft spring 54.

Referring once again to FIGS. 1–5, the circuit breaker device 8 described above also includes means for providing an improved contact status indication arrangement for locally indicating the status of the contacts 18 and 20. The contact status indication arrangement includes a trip flag 88, a status insert 90, a clear plastic lens 92, a flag guide 94, a status flag 96, and a status flag torsion spring 98. The trip flag 88, status insert 90 and status flag 96 are preferably colored fluorescent orange, fluorescent green and white, respectively, and are viewed through the lens 92, which is disposed in an opening 99 (FIG. 14) in the housing 10. Only one status indicator is viewable through the lens at any one time, each indicating a different circuit breaker status. For example, when the trip flag 88 is visible, the circuit breaker device 8 is in the TRIPPED position (the circuit breaker has interrupted the current flow due to a current overload); when the status insert 90 is visible, the circuit breaker is in the OFF or OPEN position (the contacts 18 and 20 are separated); and when the status flag 96 is visible, the circuit breaker is in the ON or CLOSED position (the contacts 18 and 20 are in contact with each other). Therefore, an observer can easily determine the status of the circuit breaker by looking at the front of the circuit breaker.

Figure 2:
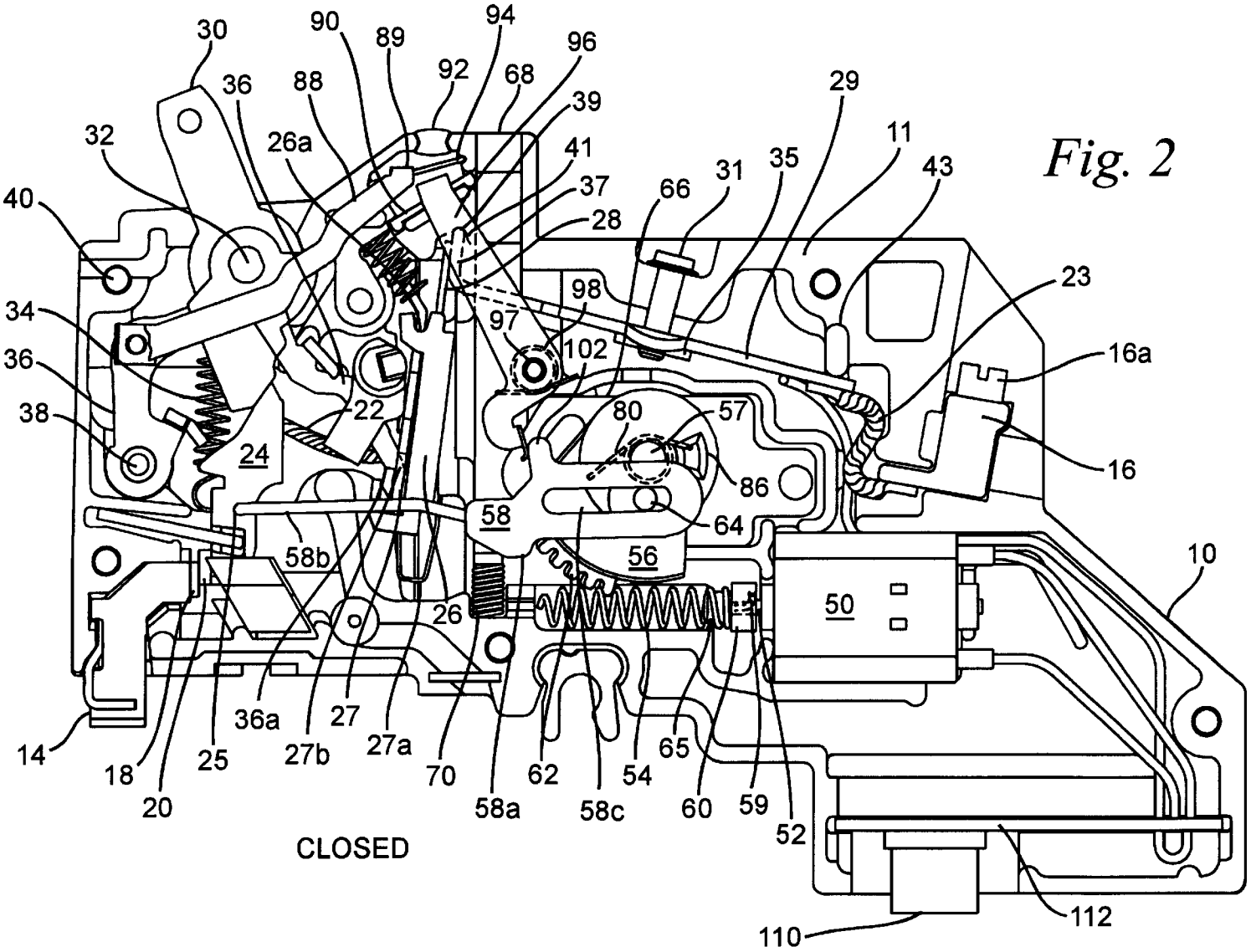
FIG. 2 is a side view of the circuit breaker of FIG. 1 with the cover removed, showing the circuit breaker in the CLOSED position.

One end of the trip flag 88 is coupled to the trip lever 36 via the reset pin 40 and the other end has a foot extension 89 (shown best in FIG. 1) which extends outwardly therefrom in a position substantially perpendicular thereof The foot extension 89, as seen in FIG. 1, rides on the flag guide 94 as the trip flag 88 moves forward when the circuit breaker moves into the TRIPPED position (FIG. 4). The flag guide 94 is a staple-shaped piece of wire disposed in guide slots 100 (FIG. 14) in the housing 10 and provides a reliable guide on which the trip flag 88 to travel. Furthermore, the flag guide 94 assures that the trip flag 88 is installed in the proper location during assembly of the circuit breaker. Additionally, the flag guide 94 maintains separation between the trip flag 88 and the status flag 96.

The status flag 96 rotates about a pivot pin 97 disposed in the housing 10 and has a first end thereof viewable through the lens 92 when the contacts 18 and 20 are in the CLOSED position. The other end of the status flag 96 is biased towards a knob 102 disposed on the plate 58*a* by the torsion spring 98. When the contact carrier 24 holds the movable contact 20 in engagement with the stationary contact 18, the plate 58*a* is positioned forward forcing the knob 102 into the status flag 96 and rotating it clockwise about the pivot pin 97 thereby moving the first end of the status flag 96 into a viewable position under the lens 92 to indicate that the contacts are CLOSED. When the contact carrier 24 is moved away from the stationary contact 18, the plate 58*a* is moved away from the stationary contact 18 thereby moving the knob 102 away from the status flag 96 and allowing the torsion spring 98 to rotate the status flag 96 counterclockwise into a non-viewable position (FIG. 3). The insert 90 is then viewable through the lens 90 indicating that the circuit breaker is in the OPEN position.

When the circuit breaker encounters an overcurrent condition and trips, the trip lever 36 rotates about the pin 38 in the clockwise direction causing the trip flag 88 to slide forward thereby moving the foot extension 89 of the trip flag 88 along the wire guide to a viewable position under the lens 92 to indicate that the circuit breaker has tripped. Concurrently therewith, the contact carrier 24 rotates counterclockwise causing the plate 58*a* to move towards the motor 50 thereby moving the knob 102 away from the status flag 96 and allowing the status flag 96 to rotate about the pivot pin 97 in the clockwise direction and move its first end away from the lens 92 and into a hidden position.

Most of the non-conductive components, e.g., the housing 10, the cover 12 and the operating handle 30, may be made from a thermoset-type plastic. The hook-shaped coupling member 58*b* and the springs may be manufactured using any durable metal.

Electrically, the preferred circuit breaker device 8 is operated using signals which pass through a plug-in connector 110 and a circuit board assembly 112. The plug-in connector 110 provides a conveniently removable interconnection between the circuit breaker and a remotely located control/monitoring device, while the circuit board assembly 112 carries the interface circuit for controlling the motor 50 and monitoring the current delivered to the load through load terminal 16.

Figure 15:
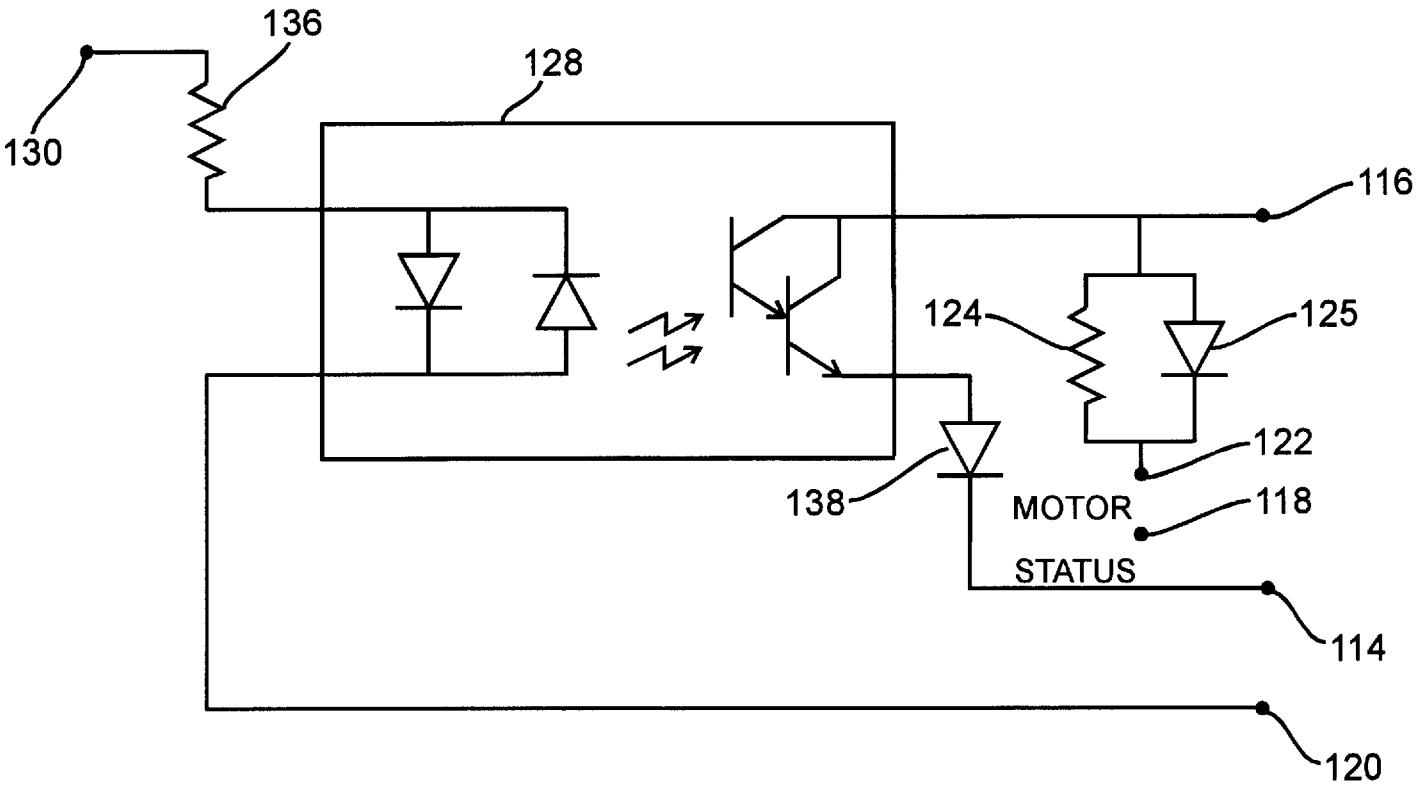
FIG. 15 is a schematic diagram of an electrical circuit which may be used to control the circuit breaker device of FIG. 1 and to monitor and report the status of the contacts.

FIG. 15 depicts a schematic diagram of the circuit on the circuit board assembly 112. There are four leads carried by the plug-in connector 110: a status lead 114, positive and negative motor leads 116 and 118, and a neutral lead 120, which is common to the circuit breaker and the device providing the remote control signaling.

The motor 50, which is preferably a FK130S-10300 Mabuchi DC motor, is directly connected to the circuit board assembly 112 at lead 118 and lead 122, with lead 116 connected to the motor 50 indirectly through a parallel resistor/diode arrangement 124/125. The parallel resistor/diode arrangement 124/125 serves two functions. The diode 125 may be used to provide current flow in a unilateral direction, while the resistor 124 is used to control the power provided from lead 116 to the motor 50.

The value of the resistor 124 is selected according to the necessary current specified to operate the motor. In the event that the lead 116 is used to control a motor, e.g., for controlling two or three circuit breaker poles, the resistance required will vary. For single pole operation by the FK130S-10300 Mabuchi motor exemplified above, the value of the resistor 124 is preferably 12 Ohms.

Forward and reverse rotation of the motor shaft 52 is then provided by applying the appropriate voltage to either lead 116 or lead 118. Provision of +24 Volts over lead 116, with respect to ground, will rotate the motor shaft 52 to cause the contact carrier 24 to separate the contacts 18 and 20, and provision of −24 Volts over lead 118, with respect to ground, will rotate the motor shaft 52 in the opposite direction to allow the contacts 18 and 20 to reconnect in the previously discussed manner.

The current that is provided to the load is remotely monitored using a sensor which is optically or magnetically coupled to the load side of the circuit breaker and communicatively coupled to the remote control/monitoring station via status lead 114 and the plug-in connector 110. The status lead 114 may be directly connected (or coupled via a radio or other non-wire interface) to the remote control signaling device to report whether or not the current path to the load has been interrupted. This is accomplished using a line isolation circuit, e.g., opto-isolator 128 (FIG. 15), having an input connected to the load terminal 16 and having an output, lead 114, connected directly to the remote control signaling device. While current is being provided to the load, current passes through current limiting resistor 136 to activate the opto-isolator 128. When activated, the opto-isolator 128 passes current through its collector-emitter output ports so as to report to the remote control/monitoring device via leads 116 and 114. When current to the load is interrupted, voltage at lead 130 is absent and the output ports of the opto-isolator 128 do not pass current; thereby indicating to the remote control/monitoring device that the contacts have interrupted the current path provided to the load. The resistor 136, preferably 180 k Ohms at a ½ Watt rating, may be used at the input of the opto-isolator 128 to offset the heat dissipating through the opto-isolator 128. A diode 138 may be used to prevent reverse current from causing false contact status readings in other parts of the system, e.g., from another circuit board assembly 112 OR-tied at lead 114.

The signal which is transmitted from the remote control/monitoring device to open or close the contacts is preferably a DC pulse having a prescribed width. This pulse width is selected in accordance with a calculated and pre-measured test signal to rotate the gear 56 over a predetermined angle and, thus, move the contact carrier 24 linearly over a predetermined length so that the contacts 18 and 20 are separated or closed.

The remote control/monitoring device may then check lead 114 to determine if the circuit breaker properly responded to the transmitted contacts-open (contacts-closed) command. If the lead 114 indicates that the contacts-open (contacts-closed) command was not obeyed properly, the remote control/monitoring device may then transmit one or more additional pulses in an attempt to move the contact carrier 24 slightly further. Preferably, the remote control/monitoring device transmits up to three additional pulses, one at a time, until the lead 114 indicates that the contact carrier 24 has reacted as instructed. Preferably, the original pulse width is about 47 milliseconds to open the contacts and about 14 milliseconds to close the contacts. The pulse width of each of the follow-up pulses is equivalent to the original pulse width.

As those skilled in the art will appreciate, the present invention can be adapted and configured for use with a wide variety of circuit breakers and other circuit interrupters. The present invention is suitable for use with low, medium and high voltage applications and in various phase configurations. The term circuit breaker is defined to include but not be limited to, single or polyphase circuit breakers, vacuum or air circuit breakers, all types of circuit interrupters, fusible switches, switchgear, and the like.

The foregoing description is not limited to the specific embodiment herein described, but rather by the scope of the claims which are appended hereto. For example, although the invention has been described with reference to a single pole circuit breaker, the design may be easily adapted to a multi-pole circuit breaker or other circuit interrupters to be operated from a remote location. The term circuit breaker device as used herein includes, without limitations, any type of circuit interrupter having at least an open and closed position to control the completion of a circuit path.

What is claimed is:

1. A circuit breaker device for interrupting power in a circuit path between a source and a load, comprising:

a housing;

a lens disposed in said housing;

a first contact and a second contact within said housing and cooperatively arranged in the circuit path so as to provide current from the source to the load;

a contact carrier carrying said second contact and moveable between (i) a CLOSED position wherein said second contact is engaged with said first, (ii) an OPEN position wherein said second contact is spaced apart from said first contact and (iii) a TRIPPED position wherein the circuit path is interrupted in response to predetermined current conditions;

a contact position indicator viewable external to said housing through said lens and disposed in said housing for indicating the position of said first and second contacts, said position indicator includes a trip flag; a status insert and a status flag, only one of said trip flag, status insert, or status flag viewable at one time through the lens; and a guide member disposed in said housing and configured to guide a viewable end of said trip flag between at least two different positions.

2. The device in claim 1, wherein said guide member is a substantially u-shaped member having two ends both secured in said housing and a middle portion for guiding said viewable end of said trip flag.

3. The device in claim 2, wherein each one of said two ends of said guide member is disposed in a separate slot disposed in said housing.

4. The device in claim 1, wherein said guide member further maintaining separation between the paths of said trip flag and said status flag.

5. The device in claim 1, wherein said trip flag having a viewable end visible through said lens when said contact carrier is in the TRIPPED position, said status insert viewable through said lens when said contact carrier is in the OPEN position, and said status flag having a viewable end visible through said lens when said contact carrier is in the CLOSED position.

6. The device in claim 1, wherein said trip flag, said status insert and said status flag are all viewed externally through said lens.

7. A circuit breaker device for interrupting power in a circuit path between a source and a load, comprising:

a housing;

a lens disposed in said housing;

a first contact and a second contact within said housing and cooperatively arranged in the circuit path so as to provide current from the source to the load and at least one of the contacts being secured to a contact carrier which is movable for interrupting the power provided to the load;

a trip flag disposed in said housing, said trip flag movable between (i) a viewable position wherein said trip flag is in said viewable position when said trip flag is visible through said lens thereby indicating that the circuit path has been interrupted in response to predetermined current conditions and (ii) a non-viewable positions wherein said trip flag is in said non-viewable position when said trip flag is not visible through said lens;

a status flag disposed in said housing, said status flag rotatable between (i) a viewable position wherein said status flag is in said viewable position when said trip flag is visible through said lens thereby indicating that said first contact is engaged with said second contact and (ii) a non-viewable positions wherein said status flag is in said non-viewable position when said status flag is not visible through said lens;

a status insert disposed in said housing and viewable through said lens when said first contact is not engaged with said second contact and the circuit path has not been interrupted in response to predetermined current conditions thereby indicating that the first and second contacts are separated; and a substantially u-shaped guide member having two ends both secured in said housing and a middle portion for guiding one end of said trip flag.

8. The device in claim 7, wherein said guide member further maintaining separation between said trip flag and said status flag.

9. The device in claim 7, wherein each one of said two ends of said guide member is disposed in a slot disposed in said housing.

10. The device in claim 7, further including a torsion spring for biasing said status flag in said non-viewable position.

11. The device in claim 7, wherein said trip flag, said status insert and said status flag are all viewed externally through said lens.

12. A remotely controllable circuit breaker device for interrupting power in a circuit path between a source and a load, comprising:

a housing;

a lens disposed in said housing;

a first contact and a second contact within said housing and cooperatively arranged in the circuit path so as to provide current from the source to the load;

a contact carrier carrying said second contact and moveable between (i) a CLOSED position wherein said second contact is engaged with said first, (ii) an OPEN position wherein said second contact is spaced apart from said first contact and (iii) a TRIPPED position wherein the circuit path is interrupted in response to predetermined current conditions;

a contact status indication arrangement viewable through said lens and disposed in said housing for indicating the status of said first and second contacts, said status indication arrangement includes a trip flag, a status insert and a status flag, said trip flag having a viewable end and said status flag having a viewable end, wherein said viewable end of said trip flag is visible through said lens when said contact carrier is in the TRIPPED position, said status insert viewable through said lens when said contact carrier is in the OPEN position, and said viewable end of the status flag is visible through said lens when said contact carrier is in the CLOSED position;

a guide member disposed in said housing for guiding said trip flag and for maintaining separation between said trip flag and said status flag, said guide member being substantially u-shaped member having two ends both secured in said housing and a middle portion for guiding said viewable lend of said trip flag;

a motor having a rotatable shaft, said motor being responsive to open and close remote control signals generated from a remote location;

gear driving means, rotatably responsive to the rotatable shaft, for moving said contact carrier so that the circuit path may be interrupted or established, in response to the remote control signals; and a coupling arrangement, having a first part coupled to said contact carrier and a second part coupled to said gear driving means, operating in a normal mode which is responsive to said gear driving means so that the circuit path is interrupted and established in response to the open and close remote control signals, respectively.

13. The device in claim 12, wherein each one of said two ends of said guide member is disposed in a separate slot disposed in said housing.

14. The device of claim 12, wherein said trip flag, said status insert and said status flag are all viewed externally through said lens.

15. The device of claim 12, wherein said status flag having one end engaging said second part of said coupling arrangement for forcing said status flag to rotate about a pin into said viewable position when said first contact is engaged with said second contact.

* * * * *